US009924291B2

(12) United States Patent
Milne et al.

(10) Patent No.: US 9,924,291 B2
(45) **Date of Patent: *Mar. 20, 2018**

(54) DISTRIBUTED WIRELESS SPEAKER SYSTEM

(71) Applicant: Sony Corporation, Tokyo (JP)

(72) Inventors: James R. Milne, Ramona, CA (US); Gregory Carlsson, Santee, CA (US)

(73) Assignee: Sony Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/044,920

(22) Filed: Feb. 16, 2016

(65) Prior Publication Data

US 2017/0238120 A1 Aug. 17, 2017

(51) Int. Cl.

| | |
|---|---|
| ***H04S 7/00*** | (2006.01) |
| ***H04R 5/02*** | (2006.01) |
| ***H04S 5/00*** | (2006.01) |

(52) U.S. Cl.

CPC ..... *H04S 7/308* (2013.01); *H04R 5/02* (2013.01); *H04S 5/00* (2013.01); *H04S 7/302* (2013.01); *H04R 2420/07* (2013.01); *H04S 2400/01* (2013.01); *H04S 2400/03* (2013.01)

(58) Field of Classification Search

CPC . H04S 7/00; G06F 3/165; G06F 3/162; H04B 1/3833; H04H 60/05

USPC ..... 381/17, 23, 77, 78, 80, 81, 300; 455/416

See application file for complete search history.

(56) References Cited

U.S. PATENT DOCUMENTS

| | | | | |
|---|---|---|---|---|
| 4,332,979 A | | 6/1982 | Fischer | |
| 6,091,826 A | | 7/2000 | Laitinen et al. | |
| 6,128,318 A | * | 10/2000 | Sato | G06F 1/14 370/503 |
| 6,239,348 B1 | | 5/2001 | Metcalf | |
| 6,317,503 B1 | | 11/2001 | Mercs et al. | |
| 6,329,908 B1 | | 12/2001 | Frecska | |
| 6,611,678 B1 | * | 8/2003 | Zweig | H03J 1/0075 455/161.3 |
| 6,741,708 B1 | | 5/2004 | Nakatsugawa | |
| 7,007,106 B1 | * | 2/2006 | Flood | H04L 7/08 370/503 |
| 7,146,011 B2 | | 12/2006 | Yang et al. | |
| 7,483,538 B2 | * | 1/2009 | McCarty | H04R 5/02 381/77 |

(Continued)

FOREIGN PATENT DOCUMENTS

| | | | |
|---|---|---|---|
| EP | 2346028 | A1 | 7/2011 |
| JP | 2005080227 | A | 3/2005 |
| WO | 2014184353 | A1 | 11/2014 |

OTHER PUBLICATIONS

Gregory Peter Carlsson, Keith Resch, Oscar Manuel Vega, "Networked Speaker System with Follow Me", related U.S. Appl. No. 14/974,413, Non-Final Office Action dated Oct. 21, 2016.

(Continued)

*Primary Examiner* — Mohammad Islam
(74) *Attorney, Agent, or Firm* — John L. Rogitz

(57) ABSTRACT

A master device receives audio, down-mixes the audio to stereo if it is not already in stereo, and then up-mixes the stereo into as many channels as there speakers in the network. The up-mixing can be based on the number and locations of the speakers, which may be determined automatically using a real time location system such as ultra wide band (UWB) location determination techniques. The master device sends each speaker the stereo only, with each speaker also up-mixing the stereo into at least its own respective channel and in some cases into all N channels, selecting from the rendered "N" channels that result from the up-mix the channel indicated as being associated with the particular location of the particular speaker.

20 Claims, 6 Drawing Sheets

(56) References Cited

U.S. PATENT DOCUMENTS 7,483,958 B1* 1/2009 Elabbady ..... G06F 21/10 709/217
7,492,913 B2 2/2009 Connor et al.
7,760,891 B2 7/2010 Biegelsen
7,801,315 B2 9/2010 Watanabe et al.
8,345,883 B2 1/2013 Takumai et al.
8,605,921 B2 12/2013 Hesdahl
9,282,196 B1 3/2016 Norris et al.
9,288,597 B2 3/2016 Carlsson et al.
9,300,419 B2 3/2016 Knowles
9,323,335 B2 4/2016 Williamson et al.
9,369,801 B2 6/2016 Carlsson et al.
9,402,145 B2 7/2016 Carlsson et al.
9,426,551 B2 8/2016 Carlsson et al.
9,485,556 B1 11/2016 List
9,560,449 B2 1/2017 Carlsson et al.
9,693,168 B1 6/2017 Carlsson et al.
9,693,169 B1 6/2017 Carlsson et al.
9,699,579 B2 7/2017 Carlsson et al.
2001/0055397 A1 12/2001 Norris et al.
2003/0099212 A1* 5/2003 Anjum ..... H04W 92/02 370/328
2003/0118198 A1 6/2003 Croft et al.
2004/0208324 A1 10/2004 Cheung et al.
2006/0126878 A1 6/2006 Takumai et al.
2006/0227980 A1 10/2006 Barger
2007/0183618 A1 8/2007 Ishii et al.
2007/0211022 A1 9/2007 Boillot
2007/0226530 A1* 9/2007 Celinski ..... G06F 1/12 713/500
2007/0230736 A1 10/2007 Boesen
2007/0233293 A1 10/2007 Villemoes et al.
2008/0031470 A1 2/2008 Angelhag
2008/0089268 A1* 4/2008 Kinder ..... H04L 1/0015 370/315
2008/0253575 A1 10/2008 Lorgeoux et al.
2009/0069081 A1 3/2009 Thorner
2009/0228285 A1 9/2009 Schnell et al.
2009/0252338 A1 10/2009 Koppens et al.
2009/0264114 A1* 10/2009 Virolainen ..... H04M 3/56 455/416
2009/0298420 A1* 12/2009 Haartsen ..... H04J 3/0658 455/3.06
2010/0272271 A1 10/2010 Hayakawa et al.
2010/0299639 A1 11/2010 Ramsay et al.
2010/0316237 A1* 12/2010 Elberbaum ..... H04M 11/025 381/300
2011/0103592 A1 5/2011 Kim et al.
2012/0039477 A1 2/2012 Schijers et al.
2012/0058727 A1* 3/2012 Cook ..... H04R 5/02 455/41.3
2012/0070004 A1* 3/2012 LaBosco ..... H04H 20/30 381/2
2012/0087503 A1* 4/2012 Watson ..... H04S 3/008 381/23
2012/0120218 A1 5/2012 Flaks et al.
2012/0177225 A1 7/2012 Springfield et al.
2012/0207307 A1 8/2012 Engdegard et al.
2012/0314872 A1 12/2012 Tan et al.
2013/0077803 A1 3/2013 Konno et al.
2013/0121515 A1 5/2013 Hooley et al.
2013/0223660 A1 8/2013 Olafsson et al.
2013/0272527 A1 10/2013 Oomen et al.
2013/0279888 A1* 10/2013 Zeng ..... H04N 21/4307 386/357
2014/0254811 A1 9/2014 Takeda et al.
2014/0254829 A1 9/2014 Wang et al.
2014/0270306 A1 9/2014 Luna et al.
2014/0278438 A1 9/2014 Hart et al.
2014/0287806 A1 9/2014 Balachandreswaran
2014/0297296 A1 10/2014 Koppens et al.
2014/0323036 A1* 10/2014 Daley ..... H04H 20/08 455/3.06
2014/0328485 A1* 11/2014 Saulters ..... G06F 3/165 381/17
2014/0355765 A1 12/2014 Kulavik et al.
2015/0077859 A1 3/2015 Kanetaka et al.
2015/0078579 A1 3/2015 Lopez
2015/0078595 A1 3/2015 Shintani et al.
2015/0086035 A1 3/2015 Shin
2015/0104026 A1 4/2015 Kappus et al.
2015/0128194 A1 5/2015 Kuang et al.
2015/0139439 A1 5/2015 Norris et al.
2015/0176890 A1 6/2015 Spanos et al.
2015/0192241 A1 7/2015 Shannahan et al.
2015/0195649 A1 7/2015 Vogt
2015/0199122 A1 7/2015 Garmark et al.
2015/0208184 A1 7/2015 Tan et al.
2015/0215722 A1* 7/2015 Milne ..... H04S 7/305 381/300
2015/0215723 A1 7/2015 Carlsson et al.
2015/0245157 A1 8/2015 Seefeldt
2015/0304789 A1 10/2015 Babayoff et al.
2015/0358768 A1 12/2015 Luna et al.
2015/0373449 A1 12/2015 Jackson
2015/0382129 A1 12/2015 Florencio et al.
2016/0014536 A1 1/2016 Sheen
2016/0021454 A1 1/2016 Liang et al.
2016/0150314 A1 5/2016 Nishidate
2016/0157008 A1 6/2016 Zhang et al.
2016/0165337 A1 6/2016 Trestain et al.
2016/0171964 A1 6/2016 Kim et al.
2016/0174012 A1 6/2016 Tan et al.
2016/0195856 A1 7/2016 Spero
2016/0286330 A1 9/2016 Kofman et al.
2016/0286350 A1 9/2016 Lin et al.
2016/0350067 A1* 12/2016 Sundaresan ..... G06F 3/165
2016/0359512 A1* 12/2016 Fathollahi ..... H04B 1/3833
2017/0019742 A1 1/2017 Rappoport
2017/0045941 A1 2/2017 Tokubo et al.
2017/0064457 A1 3/2017 Kupershmidt et al.
2017/0086008 A1 3/2017 Robinson
2017/0164099 A1 6/2017 Shintani et al.

OTHER PUBLICATIONS

Gregory Peter Carlsson, Keith Resch, Oscar Manuel Vega, "Networked Speaker System with Follow Me", related U.S. Appl. No. 14/974,413, Applicant's response to Non-Final Office Action filed Oct. 26, 2016.

Gregory Peter Carlsson, Steven Martin Richman, James R. Milne, "Distributed Wireless Speaker System", related pending U.S. Appl. No. 14/158,396 non-final office action dated Apr. 29, 2016.

Gregory Peter Carlsson, Steven Martin Richman, James R. Milne, "Distributed Wireless Speaker System", related pending U.S. Appl. No. 14/158,396 applicants response to non-final office action filed May 2, 2016.

"Ack Pro Mid-Sized Ball Bearing Brushless Gimbal With Turnigy 4008 Motors", Hobbyking.com, Retrieved on Nov. 27, 2015 from http://www.hobbyking/store/_51513_ACK_Pro_Mid_Sized_Ball_Bearing_Brushless_Gimbal_With_Turnigy_4008_Motors_NEX5_and_GF.html.

Patrick Lazik, Niranjini Rajagopal, Oliver Shih, Bruno Sinopoli, Anthony Rowe, "ALPS: A Bluetooth and Ultrasound Platform for Mapping and Localization", Dec. 4, 2015, Carnegie Mellon University.

Santiago Elvira, Angel De Castro, Javier Garrido, "ALO4: Angle Localization and Orientation System with Four Receivers", Jun. 27, 2014, International Journal of Advanced Robotic Systems.

Woon-Seng Gan, Ee-Leng Tan, Sen M. Kuo, "Audio Projection: Directional Sound and Its Applications in Immersive Communication", 2011, IEE Signal Processing Magazine, 28(1), 43-57.

Peter Shintani, Gregory Peter Carlsson, Morio Usami, Kiyoto Shibuya, Norihiro Nagai, Masaomi Nishidate, "Gimbal-Mounted Ultrasonic Speaker for Audio Spatial Effect", file history of related U.S. Appl. No. 14/968,349 filed Dec. 14, 2015.

Gregory Carlsson, Masaomi Nishidate, Morio Usami, Kiyoto Shibuya, Norihiro Nagai, Peter Shintani, "Ultrasonic Speaker

(56) References Cited

OTHER PUBLICATIONS

Assembly for Audio Spatial Effect", file history of related U.S. Appl. No. 15/018,128, filed Feb. 8, 2016.
Peter Shintani, Gregory Carlsson, "Gimbal-Mounted Linear Ultrasonic Speaker Assembly", file history of related U.S. Appl. No. 15/068,806, filed Mar. 14, 2016.
Gregory Carlsson, Morio Usami, Peter Shintani, "Ultrasonic Speaker Assembly with Ultrasonic Room Mapping", file history of related U.S. Appl. No. 15/072,098, filed Mar. 16, 2016.
Gregory Peter Carlsson, Keith Resch, Oscar Manuel Vega, "Networked Speaker System with Follow Me", related U.S. Appl. No. 14/974,413, Applicant's response to Final Office Action filed Dec. 2, 2016.
Gregory Peter Carlsson, Keith Resch, Oscar Manuel Vega, "Networked Speaker System with Follow Me", related U.S. Appl. No. 14/974,413, Non-Final Office Action dated Dec. 21, 2016.
James R. Milne, Gregory Carlsson, Steven Richman, Frederick Zustak, "Wireless Speaker System", related U.S. Appl. No. 15/044,981, Applicant's response to Non-Final Office Action filed Dec. 14, 2016.
James R, Milne, Gregory Peter Calrsson, Steven Martin Richman, Frederick J. Zustak, "Audio Speaker System with Virtual Music Performance", related U.S. Appl. No. 14/163,415, Applicant's response to Final Office Action filed Mar. 16, 2016.
Gregory Peter Calrsson, Frederick J. Zustak, Steven Martin Richman, James R. Milne, "Wireless Speaker System with Distributed Low (Bass) Frequency", related U.S. Appl. No. 14/163.213, Applicant's response to Final Office Action filed Mar. 15, 2016.
Peter Shintani, Gregory Carlsson, "Ultrasonic Speaker Assembly Using Variable Carrier Frequency to Establish Third Dimension Sound Locating", file history of related U.S. Appl. No. 15/214,748, filed Jul. 20, 2016.
Gregory Peter Carlsson, Keith Resch, Oscar Manuel Vega, "Networked Speaker System with Follow Me", related U.S. Appl. No. 14/974,413, Final Office Action dated Nov. 28, 2016.
James R. Milne, Gregory Carlsson, Steven Richman, Frederick Zustak, "Wireless Speaker System", related U.S. Appl. No. 15/044,981, Non-Final Office Action dated Nov. 28, 2016.
Gregory Peter Carlsson, James R. Milne, Steven Martin Richman, Frederick J. Zustak, "Distributed Wireless Speaker System with Light Show", related U.S. Appl. No. 14/163,542, Applicant's response to Non-Final Office Action filed Apr. 6, 2016.
Gregory Carlsson, Morio Usami, Peter Shintani, "Ultrasonic Speaker Assembly With Ultrasonic Room Mapping", related U.S. Appl. No. 15/072,098, Non-Final Office Action dated Jan. 4, 2017.
James R. Milne, Gregory Peter Carlsson, Steven Martin Richman, Frederick J. Zustak, "Audio Speaker System With Virtual Music Performance", related U.S. Appl. No. 14/163,415, Non-Final Office Action dated Jan. 13, 2017.
James R. Milne, Gregory Peter Carlsson, Steven Martin Richman, Frederick J. Zustak, "Audio Speaker System With Virtual Music Performance", related U.S. Appl. No. 14/163,415, Applicant's response to Non-Final Office Action filed Jan. 17, 2017.
Gregory Peter Carlsson, Keith Resch, Oscar Manuel Vega, "Networked Speaker System with Follow Me", related U.S. Appl. No. 14/974,413, Applicant's response to Non-Final Office Action filed Jan. 5, 2017.
Gregory Carlsson, Morio Usami, Peter Shintani, "Ultrasonic Speaker Assembly with Ultrasonic Room Mapping", related U.S. Appl. No. 15/072,098, Applicant's response to Non-Final Office Action filed Jan. 3, 2017.
Gregory Carlsson, Masaomi Nishidate, Morio Usami, Kiyoto Shibuya, Norihiro Nagai, Peter Shintani, "Ultrasonic Speaker Assembly for Audio Spatial Effect", related U.S. Appl. No. 15/018,128, Non-Final Office Action dated Jan. 17, 2017.
Gregory Carlsson, Masaomi Nishidate, Morio Usami, Kiyoto Shibuya, Norihiro Nagai, Peter Shintani, "Ultrasonic Speaker Assembly for Audio Spatial Effect", related U.S. Appl. No. 15/018,128, Applicant's response to Non-Final Office Action filed Jan. 18, 2017.
Gregory Peter Carlsson, Keith Resch, Oscar Manuel Vega, "Networked Speaker System With Follow Me", related U.S. Appl. No. 14/974,413, Final Office Action dated Feb. 21, 2017.
Peter Shintani, Gregory Peter Carlsson, Morio Usami, Kiyoto Shibuya, Norihiro Nagai, Masaomi Nishidate, "Gimbal-Mounted Ultrasonic Speaker for Audio Spatial Effect", related U.S. Appl. No. 14/968,349, Non-Final Office Action dated Mar. 20, 2017.
Peter Shintani, Gregory Peter Carlsson, Morio Usami, Kiyoto Shibuya, Norihiro Nagai, Masaomi Nishidate, "Gimbal-Mounted Ultrasonic Speaker for Audio Spatial Effect", related U.S. Appl. No. 14/968,349, Applicant's response to Non-Final Office Action dated Mar. 21, 2017.
Gregory Peter Carlsson, Keith Resch, Oscar Manuel Vega, "Networked Speaker System With Follow Me", related U.S. Appl. No. 14/974,413, Applicant's response to the Final Office Action filed Mar. 21, 2017.
James R. Milne, Gregory Carlsson, "Centralized Wireless Speaker System", related U.S. Appl. No. 15/019,111, Non-Final Office Action dated Apr. 21, 2017.
James R. Milne, Gregory Carlsson, "Centralized Wireless Speaker System", related U.S. Appl. No. 15/019,111, Applicant's response to Non-Final Office Action filed May 11, 2017.
James R. Milne, Gregory Carlsson, Steven Richman, Frederick Zustak, "Wireless Speaker System", Applicant's response to Final Office Action filed May 10, 2017.
James R. Milne, Gregory Carlsson, Steven Richman, Frederick Zustak, "Wireless Speaker System", related pending U.S. Appl. No. 15/044,981, non-final office action dated Jul. 28, 2017.
James R. Milne, Gregory Carlsson, Steven Richman, Frederick Zustak, "Wireless Speaker System", related pending U.S. Appl. No. 15/044,981, applicant's response to non-final office action filed Aug. 16, 2017.
James R. Milne, Gregory Peter Carlsson, Steven Martin Richman, Frederick J. Zustak, "Audio Speaker System with Virtual Music Performance", related U.S. Appl. No. 14/163,415, Non-Final Office Action dated Jul. 12, 2017.
James R. Milne, Gregory Peter Carlsson, Steven Martin Richman, Frederick J. Zustak, "Audio Speaker System with Virtual Music Performance", related U.S. Appl. No. 14/163,415, Applicant's response to Non-Final Office Action filed Jul. 17, 2017.
Peter Shintani, Gregory Carlsson, "Gimbal-Mounted Linear Ultrasonic Speaker Assembly", related U.S. Appl. No. 15/068,806, Applicant's response to Non-Final Office Action filed Jul. 17, 2017.
Peter Shintani, Gregory Carlsson, "Ultrasonic Speaker Assembly Using Variable Carrier Frequency to Establish Third Dimension Sound Locating", related U.S. Appl. No. 15/214,748, Non-Final Office Action dated Jul. 6, 2017.
Peter Shintani, Gregory Carlsson, "Ultrasonic Speaker Assembly Using Variable Carrier Frequency to Establish Third Dimension Sound Locating", related U.S. Appl. No. 15/214,748, Applicant's response to Non-Final Office Action filed Jul. 14, 2017.
Peter Shintani, Gregory Peter Carlsson, Morio Usami, Kiyoto Shibuya, Norihiro Nagai, Masaomi Nishidate, "Gimbal-Mounted Ultrasonic Speaker for Audio Spatial Effect", related U.S. Appl. No. 14/968,349, Non-Final Office Action dated Sep. 14, 2017.
Peter Shintani, Gregory Peter Carlsson, Morio Usami, Kiyoto Shibuya, Norihiro Nagai, Masaomi Nishidate, "Gimbal-Mounted Ultrasonic Speaker for Audio Spatial Effect", related U.S. Appl. No. 14/968,349, Applicant's response to Non-Final Office Action filed Sep. 18, 2017.
Peter Shintani, Gregory Peter Carlsson, Morio Usami, Kiyoto Shibuya, Norihiro Nagai, "Gimbal-Mounted Ultrasonic Speaker for Audio Spatial Effect", related U.S. Appl. No. 14/968,349, Final Office Action dated May 23, 2017.
Peter Shintani, Gregory Peter Carlsson, Morio Usami, Kiyoto Shibuya, Norihiro Nagai, "Gimbal-Mounted Ultrasonic Speaker for Audio Spatial Effect", related U.S. Appl. No. 14/968,349, Applicant's response to Final Office Action dated Jun. 12, 2017.
Peter Shintani, Gregory Carlsson, "Gimbal-Mounted Linear Ultrasonic Speaker Assembly", related U.S. Appl. No. 15/068,806, Final Office Action dated May 25, 2017.

(56) References Cited

OTHER PUBLICATIONS

Peter Shintani, Gregory Carlsson, "Gimbal-Mounted Linear Ultrasonic Speaker Assembly", related U.S. Appl. No. 15/068,806, Applicant's response to Final Office Action filed Jun. 12, 2017.
James R. Milne, Gregory Carlsson, "Centralized Wireless Speaker System", related U.S. Appl. No. 15/019,111, Final Office Action dated Jun. 9, 2017.
James R. Milne, Gregory Peter Carlsson, Steven Martin Richman, Frederick J. Zustak, "Audio Speaker System with Virtual Music Performance", related U.S. Appl. No. 14/163,415, Final Office Action dated Mar. 29, 2017.
James R. Milne, Gregory Peter Carlsson, Steven Martin Richman, Frederick J. Zustak, "Audio Speaker System with Virtual Music Performance", related U.S. Appl. No. 14/163,415, Applicant's response to Final Office Action filed Apr. 4, 2017.
James R. Milne, Gregory Carlsson, "Centralized Wireless Speaker System", related U.S. Appl. No. 15/019,111, Final Office Action dated Mar. 31, 2017.
James R. Milne, Gregory Carlsson, "Centralized Wireless Speaker System", related U.S. Appl. No. 15/019,111, Applicant's response to Final Office Action filed Apr. 4, 2017.
Peter Shintani, Gregory Carlsson, "Gimbal-Mounted Linear Ultrasonic Speaker Assembly", related U.S. Appl. No. 15/068,806, Non-Final Office Action dated Apr. 10, 2017.
Peter Shintani, Gregory Carlsson, "Gimbal-Mounted Linear Ultrasonic Speaker Assembly", related U.S. Appl. No. 15/068,806, Applicant's response to Non-Final Office Action filed Apr. 12, 2017.
James R. Milne, Gregory Carlsson, Steven Richman, Frederick Zustak, "Wireless Speaker System", related U.S. Appl. No. 15/044,981, Final Office Action dated Apr. 12, 2017.
James R. Milne, Gregory Carlsson, Steven Richman, Frederick Zustak, "Wireless Speaker System", related U.S. Appl. No. 15/044,981, final office action dated Oct. 5, 2017.
Peter Shintani, Gregory Peter Carlsson, Morio Usami, Kiyoto Shibuya, Norihiro Nagai, Masaomi Nishidate, "Gimbal-Mounted Ultrasonic Speaker for Audio Spatial Effect", related U.S. Appl. No. 15/044,920, Final Office Action dated Nov. 9, 2017.
Gregory Peter Carlsson, Steven Martin Richman, James R. Milne, "Distributed Wireless Speaker System", related U.S. Appl. No. 14/158,396, Final Office Action dated Jun. 20, 2016.
Gregory Peter Carlsson, Steven Martin Richman, James R. Milne, "Distributed Wireless Speaker System", related U.S. Appl. No. 14/158,396, Applicant's response to Final Office Action filed Jun. 20, 2016.
James R. Milne, Gregory Carlsson, "Centralized Wireless Speaker System", related U.S. Appl. No. 15/019,111, Non-Final Office Action dated Jan. 20, 2017.
James R. Milne, Gregory Carlsson, "Centralized Wireless Speaker System", related U.S. Appl. No. 15/019,111, Applicant's response to Non-Final Office Action filed Jan. 25, 2017.
Gregory Carlsson, Masaomi Nishidate, Morio Usami, Kiyoto Shibuya, Norihiro Nagai, Peter Shintani, "Ultrasonic Speaker Assembly for Audio Spatial Effect", related U.S. Appl. No. 15/018,128, Final Office Action dated Feb. 27, 2017.
Gregory Carlsson, Masaomi Nishidate, Morio Usami, Kiyoto Shibuya, Norihiro Nagai, Peter Shintani, "Ultrasonic Speaker Assembly for Audio Spatial Effect", related U.S. Appl. No. 15/018,128, Applicant's response to Final Office Action filed Mar. 6, 2017.

* cited by examiner

Networked-Speaker Block Diagram

DISTRIBUTED WIRELESS SPEAKER SYSTEM

FIELD

The present application relates generally to wireless speaker systems.

BACKGROUND

People who enjoy high quality sound, for example in home entertainment systems, prefer to use multiple speakers for providing stereo, surround sound, and other high fidelity sound. As understood herein, optimising speaker-settings for the particular room and speaker location in that room does not lend itself to easy accomplishment by non-technical users, who moreover can complicate initially established settings by moving speakers within a room to non-standard speaker configuration locations and moving speakers to other rooms or outside the building.

SUMMARY

A device includes at least one computer medium that is not a transitory signal and that in turn includes instructions executable by at least one processor to receive input audio, and responsive to the input audio not being stereo, down-mix the input audio to stereo. Responsive to the input audio being stereo, it is not down-mixed. The instructions are executable to receive a number "N" representing a number of speakers in a network of speakers and send to each respective speaker the stereo such that each respective $N^{th}$ speaker can up-mix the stereo to at least an $N^{th}$ channel. In this way, a first speaker renders from the stereo at least a first channel for play thereof by the first speaker, a second speaker renders from the stereo at least a second channel for play thereof by the second speaker, and an $N^{th}$ speaker renders from the stereo at least an $N^{th}$ channel for play by the $N^{th}$ speaker.

In some examples, the device is a consumer electronics (CE) device. The device may be a master device and/or a network server communicating with a consumer electronics (CE) device associated with the network of speakers.

In example implementations, the device can be configured to up-mix the stereo and play a selected one of the N channel so rendered thereby on the device. The instructions may be executable to receive the number "N" representing the number of speakers and information representing a respective location of each speaker from a location determination module that automatically determines at least one location of at least one speaker using a real time location system (RTLS) such as ultra wide band (UWB) signal transmission. The up-mix may be based on both the number of speakers and the locations of the speakers.

In example embodiments, the instructions can be executable to receive at least three fixed points in a space associated with the speakers in the network, and at least in past based on the three fixed points and on RTLS signaling in the network of speakers, output at least one speaker location in the space. In other examples, the instructions are executable to receive at least four fixed points in a space associated with the speakers in the network, and at least in part based on the four fixed points and on UWB signaling in the network of speakers, output at least one speaker location in the space. If desired, the instructions may be executable to receive at least an expected listening location in the space, and at least in part based on the expected listening location, up-mix the stereo to render the "N" channels.

In another aspect, a method includes automatically determining, based at least in past on wireless signaling, respective locations of at least some respective speakers in a network of speakers, and automatically determining a number "N" of speakers in the network. The method includes sending each speaker in the network audio formatted in stereo. Based at least in part on the number "N" of speakers in the network and the respective locations of the speakers, each $N^{th}$ speaker up-mixes the stereo into at least a respective $N^{th}$ channel, such that a first speaker plays only a first channel selected from the "N" channels, a second speaker plays only a second channel selected from the "N" channels, and an $N^{th}$ speaker plays only an $N^{th}$ channel selected from the "N" channels.

In another aspect, a system includes N speakers, wherein N is an integer greater than one and preferably greater than two, and at least one master device configured to receive audio and to communicate with the speakers. In this aspect, a "speaker" may include not only an audio speaker per so but also attendant components including transceivers, processors, and computer memories. The master device may be configured with instructions executable to down-mix input audio to stereo and transmit to each speaker the stereo. Each speaker is configured with instructions executable to up-mix the stereo into "N" channels, and play a respective channel from among the "N" channels.

The details of the present application, both as to its structure and operation, can be best understood in reference to the accompanying drawings, in which like reference numerals refer to like parts, and in which:

DETAILED DESCRIPTION

Figure 1:
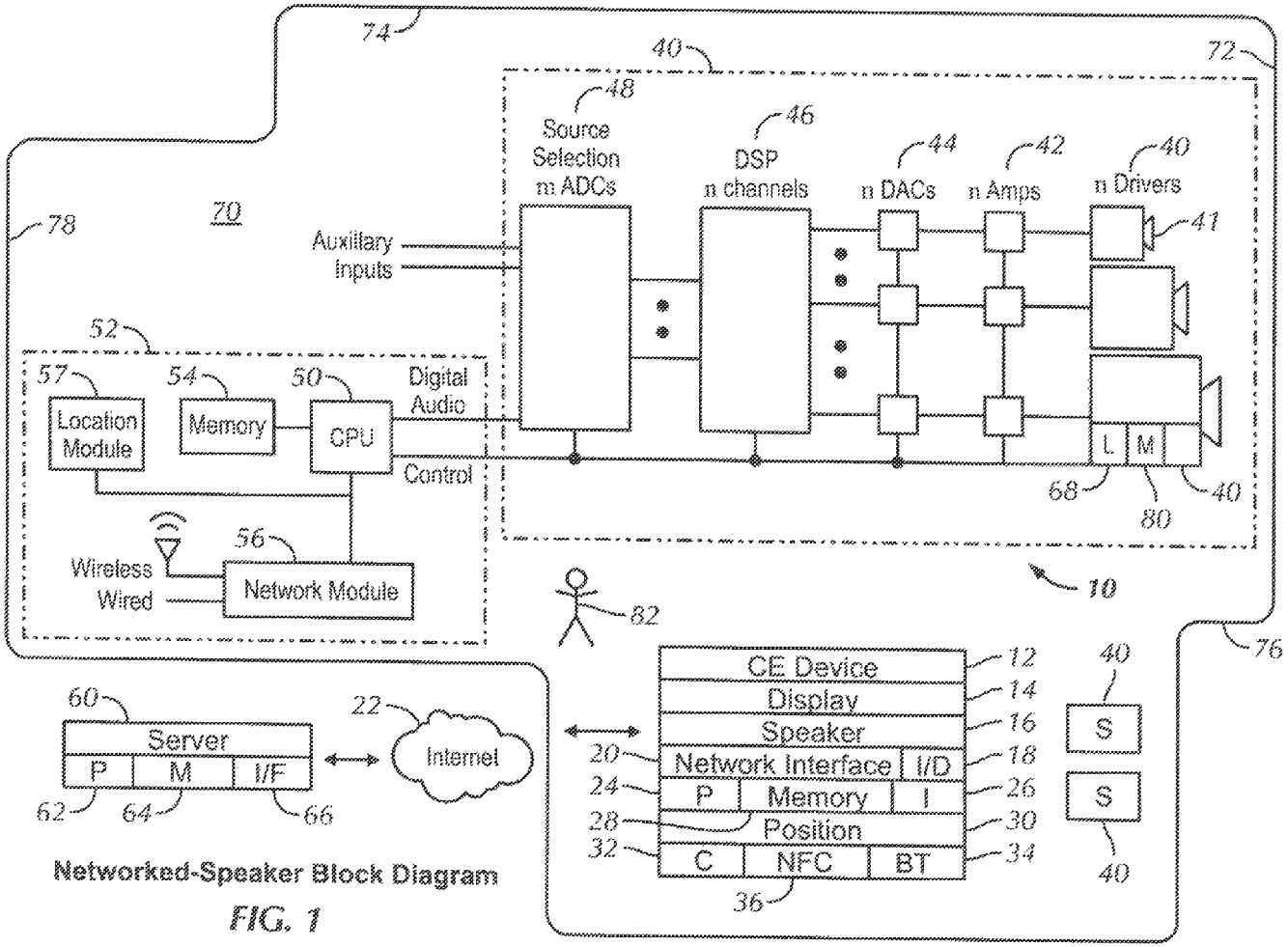
FIG. 1 is a block diagram of an example centralized system.

The present assignee's U.S. patent publication no. 2015/0208187 is incorporated herein by reference.

Also, in addition to the instant disclosure, further details on aspects of the below-described locating speakers may use Decawave's ultra wide band (UWB) techniques disclosed in one or more of the following location determination documents, all of which are incorporated herein by reference: U.S. Pat. Nos. 9,054,790; 8,870,334; 8,677,224; 8,437,432; 8,436,758; and USPPs 2008/0279307; 2012/0069868; 2012/0120874. In addition to the instant disclosure, further details on aspects of the below-described rendering including tip-mixing and down rendering may use the techniques in any one or more of the following rendering documents, all of which are incorporated herein by reference: U.S. Pat. No. 7,929,708; U.S. Pat. No. 7,853,022; USPP 2007/0297519; USPP 2009/0060204; USPP 2006/0106620; and Reams, "N-Channel Rendering: Workable 3-D Audio for 4kTV", AES 135 White paper, New York City 2013.

This disclosure relates generally to computer ecosystems including aspects of multiple audio speaker ecosystems. A system herein may include server and client components, connected over a network such that data may be exchanged between the client and server components. The client components may include one or more computing devices that have audio speakers including audio speaker assemblies per se but also including speaker-bearing devices such as portable televisions (e.g. small TVs, Internet-enabled TVs), portable computers such as laptops and tablet computers, and other mobile devices including smart phones and additional examples discussed below. These client devices may operate with a variety of operating environments. For example, some of the client computers/may employ, as examples, operating systems from Microsoft, or a Unix operating system, or operating systems produced by Apple Computer or Google. These operating environments may be used to execute one or more browsing programs, such as a browser made by Microsoft or Google or Mozilla or other browser program that can access web applications hosted by the Internet servers discussed below.

Servers may include one or more processors executing instructions that configure the servers to receive and transmit data over a network such as the Internet. Or, a client and server can be connected over a local intranet or a virtual private network.

Information may be exchanged over a network between the clients and servers. To this end and for security, servers and/or clients can include firewalls, load balancers, temporary storages, and proxies, and other network infrastructure for reliability and security. One or more servers may form an apparatus that implement methods of providing a secure community such as an online social website to network members.

As used herein, instructions refer to computer-implemented steps for processing information in the system. Instructions can be implemented in software, firmware or hardware and include any type of programmed step undertaken by components of the system.

A processor may be any conventional general purpose single- or multi-chip processor that can execute logic by means of various lines such as address lines, data lines, and control lines and registers and shift registers. A processor may be implemented by a digital signal processor (DSP), for example.

Software modules described by way of the flow charts and user interfaces herein can include various sub-routines, procedures, etc. Without limiting the disclosure, logic stated to be executed by a particular module can be redistributed to other software modules and/or combined together in a single module and/or made available in a shareable library.

Present principles described herein can be implemented as hardware, software, firmware, or combinations thereof; hence, illustrative components, blocks, modules, circuits, and steps are set forth in terms of their functionality.

Further to what has been alluded to above, logical blocks, modules, and circuits described below can be implemented or performed with a general purpose processor, a digital signal processor (DSP), a field programmable gate array (FPGA) or other programmable logic device such as an application specific integrated circuit (ASIC), discrete gate or transistor logic, discrete hardware components, or any combination thereof designed to perform the functions described herein. A processor can be implemented by a controller or state machine or a combination of computing devices.

The functions and methods described below, when implemented in software, can be written in an appropriate language such as but not limited to C# or C++, and can be stored on or transmitted through a computer-readable storage medium such as a random access memory (RAM), read-only memory (ROM), electrically erasable programmable read-only memory (EEFROM), compact disk read-only memory (CD-ROM) or other optical disk storage such as digital versatile disc (DVD), magnetic disk storage or other magnetic storage devices including removable thumb drives, etc. A connection may establish a computer-readable medium. Such connections can include, as examples, hard-wired cables including fiber optic and coaxial wires and digital subscriber line (DSL) and twisted pair wires.

Components included in one embodiment can be used in other embodiments in any appropriate combination. For example, any of the various components described herein and/or depicted in the Figures may be combined, interchanged or excluded from other embodiments.

"A system having at least one of A, B, and C" (likewise "a system having at least one of A, B, or C" and "a system having at least one of A, B, C") includes systems that have A alone, B alone, C alone, A and B together, A and C together, B and C together, and/or A, B, and C together, etc.

Now specifically referring to FIG. 1, an example system 10 is shown, which may include one or more of the example devices mentioned above and described further below in accordance with present principles. The first of the example devices included in the system 10 is an example consumer electronics (CE) device 12. The CE device 12 may be, e.g., a computerized Internet enabled ("smart") telephone, a tablet computer, a notebook computer, a wearable computerized device such as e.g. computerized Internet-enabled watch, a computerized Internet-enabled bracelet, other computerized Internet-enabled devices, a computerised Internet-enabled music player, computerized Internet-enabled head phones, a computerized Internet-enabled implantable device such as an implantable skin devices etc., and even e.g. a computerized Internet-enabled television (TV). Regardless, it is to be understood that the CE device 12 is configured to undertake present principles (e.g. communicate with other devices to undertake present principles, execute the logic described herein, and perform any other functions and/or operations described herein).

Accordingly, to undertake such principles the CE device 12 can be established by some or all of the components shown in FIG. 1. For example, the CE device 12 can include one or more touch-enabled displays 14, one or more speakers 16 for outputting audio in accordance with present principles, and at least one additional input device 18 such as e.g. an audio receiver/microphone for e.g. entering audible commands to the CE device 12 to control the CE device 12. The example CE device 12 may also include one or more network interlaces 20 for communication over at least one network 22 such as the Internet, an WAN, an LAN, etc. under control of one or more processors 24. It is to be understood that the processor 24 controls the CE device 12 to undertake present principles, including the other elements of the CE device 12 described herein such as e.g. controlling the display 14 to present images thereon and receiving input therefrom. Furthermore, note the network interface 29 may be, e.g., a wired or wireless modem or router, or other appropriate interface such as, e.g., a wireless telephony transceiver, Wi-Fi transceiver, etc.

In addition to the foregoing, the CE device 12 may also include one or more input ports 26 such as, e.g., a USB port to physically connect (e.g. using a wired connection) to another CE device and/or a headphone port to connect headphones to the CE device 12 for presentation of audio from the CE device 12 to a user through the headphones. The CE device 12 may further include one or more computer memories 28 such as disk-based or solid state storage that are not transitory signals. Also in some embodiments, the CE device 12 can include a position or location receiver such as but not limited to a GPS receiver and/or altimeter 30 that is configured to e.g. receive geographic position information from at least one satellite and provide the information to the processor 24 and/or determine an altitude at which the CE device 12 is disposed in conjunction with the processor 24. However, it is to be understood that that another suitable position receiver other than a GPS receiver and/or altimeter may be used in accordance with present principles to e.g. determine the location of the CE device 12 in e.g. all three dimensions.

Continuing the description of the CE device 12, in some embodiments the CE device 12 may include one or more cameras 32 that may be, e.g., a thermal imaging camera, a digital camera such as a webcam, and/or a camera integrated into the CE device 12 and controllable by the processor 24 to gather pictures/images and/or video in accordance with present principles. Also included on the CE device 12 may be a Bluetooth transceiver 34 and other Near Field Communication (NFC) element 36 for communication with other devices using Bluetooth and/or NFC technology, respectively. An example NFC element can be a radio frequency identification (RFID) element.

Further still, the CE device 12 may include one or more motion sensors (e.g., an accelerometer, gyroscope, cyclometer, magnetic sensor, infrared (IR) motion sensors such as passive IR sensors, an optical sensor, a speed and/or cadence sensor, a gesture sensor (e.g. for sensing gesture command), etc.) providing input, to the processor 24. The CE device 12 may include still other sensors such as e.g. one or more climate sensors (e.g. barometers, humidity sensors, wind sensors, light sensors, temperature sensors, etc.) and/or one or more biometric sensors providing input to the processor 24. In addition to the foregoing, it is noted that in some embodiments the CE device 12 may also include a kinetic energy harvester to e.g. charges battery (not shown) powering the CE device 12.

In some examples, the CE device 12 may function in connection with the below-described "master" or the CE device 12 itself may establish a "master". A "master" is used to control multiple ("n", wherein "n" is an integer greater than one) speakers 40 in respective speaker housings, each of can have multiple drivers 41, with each driver 41 receiving signals from a respective amplifier 42 over wired and/or wireless links to transduce the signal into sound (the details of only a single speaker shown in FIG. 1, it being understood that the other speakers 40 may be similarly constructed). Each amplifier 42 may receive over wired and/or wireless links an analog signal that has been converted from a digital signal by a respective standalone or integral (with the amplifier) digital to analog converter (DAC) 44. The DACs 44 may receive, over respective wired and/or wireless channels, digital signals from a digital signal processor (DSP) 46 or other processing circuit.

The DSP 46 may receive source selection signals over wired and/or wireless links from plural analog to digital converters (ADC) 48, which may is turn receive appropriate auxiliary signals and, from a control processor 50 of a master control device 52, digital audio signals over wired and/or wireless links. The control processor 50 may access a computer memory 54 such as any of those described above and may also access a network module 56 to permit wired and/or wireless communication with, e.g., the Internet. The control processor 50 may also access a location module 51 for purposes to be shortly disclosed. The location module 57 may be implemented by a UWB module made by Decawave for purposes to be shortly disclosed. One or more of the speakers 40 may also have respective location modules attached or otherwise associated with them. As an example, the master device 52 may be implemented by an audio video (AV) receiver or by a digital pre-amp processor (pre-pro).

As shown in FIG. 1, the control processor 50 may also communicate with each of the ADCs 48, DSP 46, DACs 44, and amplifiers 42 over wired and/or wireless links. In any case, each speaker 40 can be separately addressed over a network from the other speakers.

More particularly, in some embodiments, each speaker 40 may be associated with a respective network address such as but not limited to a respective media access control (MAC) address. Thus, each speaker may be separately addressed over a network such as the Internet. Wired and/or wireless communication links may be established between the speakers 40/CPU 50, CE device 12, and server 60, with the CE device 12 and/or server 60 being thus able to address individual speakers, in some examples through the CPU 50 and/or through the DSP 46 and/or through individual processing units associated with each individual speaker 40, as may be mounted integrally in the same housing as each individual speaker 40.

The CE device 12 and/or control device 52 of each individual speaker train (speaker+amplifier+DAC+DSP, for instance) may communicate over wired and/or wireless links with the Internet 22 and through, the Internet 22 with one or more network servers 60. Only a single server 60 is shown in FIG. 1. A server 60 may include at least one processor 62, at least one tangible computer readable storage medium 64 such as disk-based or solid state storage, and at least one network interface 66 that, under control of the processor 62, allows for communication with the other devices of FIG. 1 over the network 22, and indeed may facilitate communication between servers and client devices in accordance with present principles. Note that the network interface 66 may be, e.g., a wired or wireless modem or router, Wi-Fi transceiver, or other appropriate interface such as, e.g., a wireless telephony transceiver.

Accordingly, in some embodiments the server 60 may be an Internet server, may include and perform "cloud" functions such that the devices of the system 10 may access a "cloud" environment via the server 60 in example embodiments. In a specific example, the server 60 downloads a software application to the master and/or the CE device 12 for control of the speakers 40 according to logic below. The master/CE device 12 in turn can receive certain information from the speakers 40, such as their location from a real time location system (RTLS) such as but not limited to GPS or the below-described UWB, and/or the master/CE device 12 can receive input from the user, e.g., indicating the locations of the speakers 40 as further disclosed below. Based on these inputs at least in part, the master/CE device 12 may execute the speaker optimization logic discussed below, or it may upload the inputs to a cloud server 60 for processing of the optimization algorithms and return of optimization outputs to the CE device 12 for presentation thereof on the CE device 12, and/or the cloud server 60 may establish speaker configurations automatically by directly communicating with the speakers 40 via their respective addresses, in some cases through the CE device 12. Note that if desired, each speaker 40 may include one or more respective one or more UWB tags 68 from, e.g., DecaWave for purposes to be shortly described. Also, the remote control of the user, e.g., the CE device 12, may include a UWB tag.

Typically, the speakers 40 are disposed in an enclosure 70 such as a room, e.g., a living room. For purposes of disclosure, the enclosure 70 has (with respect to the example orientation of the speakers shown in FIG. 1) a front wall 72, left and right side walls 74, 76, and a rear wall 78. One or more listeners 82 may occupy the enclosure 70 to listen to audio from the speakers 40. One or microphones 80 may be arranged in the enclosure for generating signals representative of sound in the enclosure 70, sending those signals via wired and/or wireless links to the CPU 50 and/or the CE device 12 and/or the server 60. In the non-limiting example shown, each speaker 40 supports a microphone 80, it being understood that the one or more microphones may be arranged elsewhere in the system if desired.

Disclosure below may make determinations using sonic wave calculations known in the art, in which the acoustic waves frequencies (and their harmonics) from each speaker, given its role as a bass speaker, a treble speaker, a subwoofer speaker, or other speaker characterized by having assigned to it a particular frequency band, are computationally modeled in the enclosure 70 and the locations of constructive and destructive wave interference determined based on where the speaker is and where the walls 72-78 are. As mentioned above, the computations may be executed, e.g., by the CE device 12 and/or by the cloud server 60 and/or master 52.

As an example, a speaker may emit a band of frequencies between 20 Hz and 30 Hz, and frequencies (with their harmonics) of 20 Hz, 25 Hz, and 30 Hz may be modeled to propagate in the enclosure 70 with constructive and destructive interference locations noted and recorded. The wave interference patterns of other speakers based on the modeled expected frequency assignations and the locations in the enclosure 70 of those other speakers may be similarly computationally modeled together to render an acoustic model for a particular speaker system physical layout in the enclosure 70 with a particular speaker frequency assignations. In some embodiments, reflection of sound waves from one or more of the walls may be accounted for in determining wave interference. In other embodiments reflection of sound waves from one or more of the walls may not be accounted for in determining wave interference. The acoustic model based on wave interference computations may furthermore account for particular speaker parameters such as but not limited to equalization (EQ). The parameters may also include delays, i.e., sound track delays between speakers, which result in respective wave propagation delays relative to the waves from other speakers, which delays may also be accounted for in the modeling. A sound track delay refers to the temporal delay between emitting, using respective speakers, parallel parts of the same soundtrack, which temporally shifts the waveform pattern of the corresponding speaker. The parameters can also include volume, which defines the amplitude of the waves from a particular speaker and thus the magnitude of constructive and destructive interferences in the waveform. Collectively, a combination of speaker location, frequency assignation, and parameters may be considered to be a "configuration".

Figure 2:
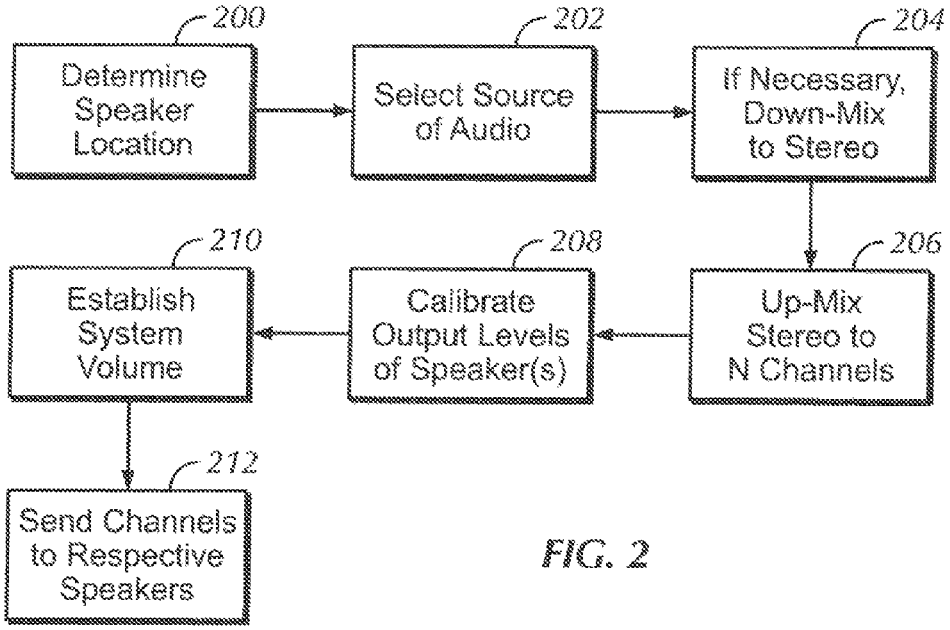
FIG. 2 is a flow chart of example overall logic pertaining to the centralized system in FIG. 1.

The configuration shown in FIG. 1 has a centralized control architecture in which the master device 52 or CE device 12 or other device functioning as a master renders two channel audio into as many channels are there are speakers in the system, providing each respective speaker with its channel. The rendering, which produces more channels than stereo and hence may be considered "up-mixing", may be executed using principles described in the above-referenced rendering references. FIG. 2 describes the overall logic flow that may be implemented using the centralized architecture of FIG. 1, in which most if not all of the logic is executed by the master device.

The logic shown in FIG. 2 may be executed by one or more of the CPU 50, the CE device 12 processor 24, and the server 60 processor 62. The logic may be executed at application boot time when a user, e.g. by means of the CE device 12, launches a control application, which prompts the user to energize the speaker system to energize the speakers 40.

Commencing at block 200, the processor(s) of the master determines room dimension, the location of each speaker in the system, and number of speakers in the room. This process is described further below. Moving to block 202, the master selects the source of audio to be played. This may be done responsive to user command input using, e.g., the device 12.

If the input audio is not two channel stereo, but instead is, e.g., seven channel audio plus a subwoofer channel (denoted "7.1 audio"), at block 204 the input audio is down-mixed to stereo (two channel). The down-mixing may be executed using principles described in the above-referenced rendering references. Other standards for down-mixing may be used, e.g., ITU-R BS.775-3 or Recommendation 7785. Then, proceeding to block 206 the stereo audio (whether received in stereo or down-mixed) is up-mixed to render "N" channels, where "N" is the number of speakers in the system. Audio is rendered for each speaker channel based on the respective speaker location (i.e., perimeter, aerial, sub in the x, y, z domain). The up-mixing is based on the current speaker locations as will be explained further shortly.

Moving to block 208, the channel/speaker output levels are calibrated per description below, preferably based on primary listener location, and then at block 210 system volume is established based on, e.g., room dimensions, number and location of speakers, etc. The user may adjust this volume. At block 212 the master sends the respective audio channels to the respective speakers.

Thus, it may now be appreciated that the speakers 40 do not have to be in a predefined configuration to support a specific audio configuration such as 5.1 or 7.1 and do not have to be disposed in the pre-defined locations of such audio configurations, because the input audio is down-mixed to stereo and then up-mixed into the appropriate number of channels for the actual locations and number of speakers.

Figure 3:
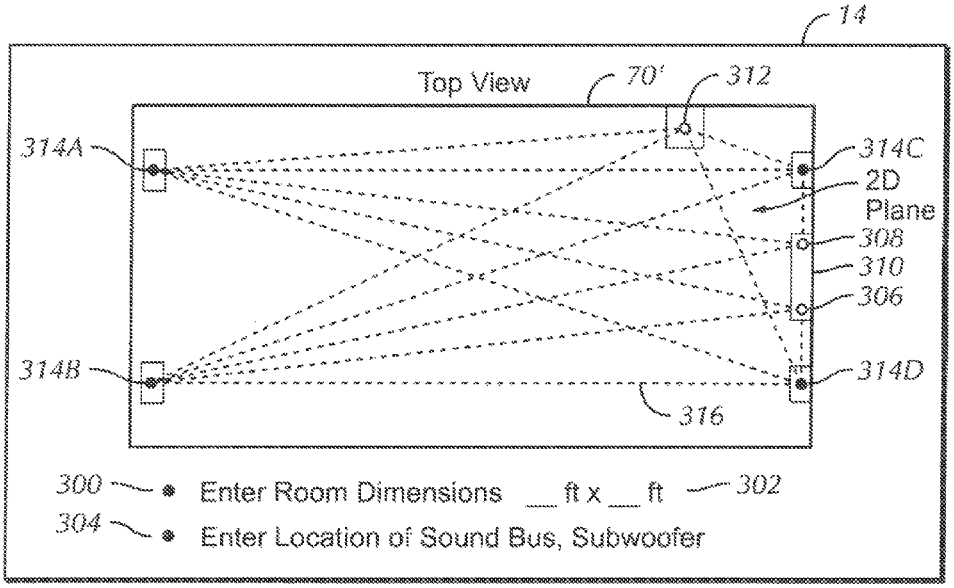
FIG. 3 is a screen shot of an example user interface (UI) that may be presented on a consumer electronics (CE) device to set up speaker location determination.
Figure 4:
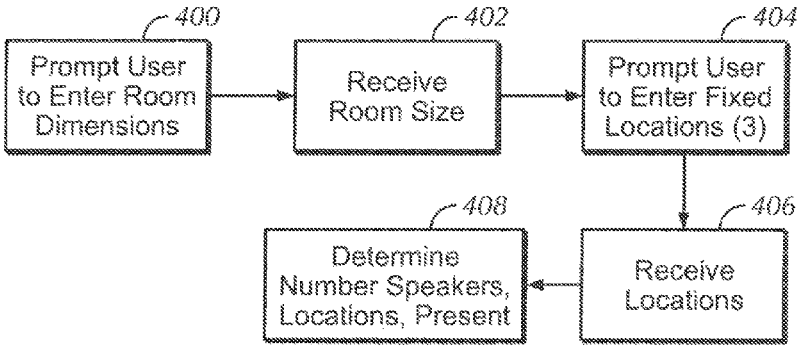
FIG. 4 is a flow chart of example logic for determining speaker locations in a room.

FIG. 3 illustrates a user interface (UI) that may be presented, e.g., on the display 14 of the CE device 12, pursuant to the logic in block 200 of FIG. 2, in the case in which speaker location determination is intended for two dimensions only (in the x-y, or horizontal plane). FIG. 4 illustrates aspects of logic that may be used with FIG. 3. An application (e.g., via Android, iOS, or URL) can be provided to the customer for use on the CE device 12.

As shown at 300 in FIG. 3 and at block 400 in FIG. 4, the user can be prompted to enter the dimensions of the room 70, an outline 70' of which may be presented on the CE device as shown once the user has entered the dimensions. The dimensions may be entered alpha-numerically, e.g., "15 feet by 20 feet" as at 302 in FIG. 3 and/or by dragging and dropping the lines of an initial outline 70' to conform to the size and shape of the room 70. The application presenting the UI of FIG. 3 may provide a reference origin, e.g., the southwest corner of the room. The room size is received from the user input at block 402 of FIG. 4.

In other embodiments, room size and shape can be determined automatically. This can be done by sending measurement waves (sonic or radio/IR) from an appropriate transceiver on the CE device 12 and detecting returned reflections from the walls of the room 70, determining the distances between transmitted and received waves to be one half the time between transmission and reception times the speed of the relevant wave. Or, it may be executed using other principles such as imaging the walls and then using image recognition principles to convert the images into an electronic map of the room.

Moving to block 404, the user may be prompted as at 304 to enter onto the UI of FIG. 3 at least three fixed locations, in one example, the left and right ends 306, 308 of a sound bar or TV 310 and the location at which the user has disposed the audio system subwoofer 312. Four fixed locations are entered for 3D rendering determinations. Entry may be effected by touching the display 14 at the locations in the outline 70' corresponding to the requested components. In a UWB implementation, each fixed location is associated with a respective UWB communication component or tag 68 shown in FIG. 1 and discussed further below. The locations are received at block 406 in FIG. 4. The user may also directly input the fact that for instance, the sound bar is against a wall, so that rendering calculations can ignore mathematically possible calculations in the region behind the wall.

Note that only speaker's determined to be in the same room are considered. Other speakers in other rooms can be ignored. When determining the speaker locations, it may first be decided if a 2D or 3D approach is to be used. This may be done by knowing how many known of fixed locations have been entered. Three known locations yields a 2D approach (all speakers are more or less residing in a single plane). Four known locations yields a 3D approach. Note further that the distance between the two fixed sound bar (or TV) locations may be known by the manufacturer and input to the processor automatically as soon as the user indicated a single location for the sound bar. In some embodiments, the subwoofer location can be input by the user by entering the distance from the sound bar to the subwoofer. Moreover, if a TV is used for two of the fixed locations, the TV may have two locators mounted on it with a predetermined distance between the locators stored in memory, similar to the sound bar. Yet again, standalone location markers such as UWB tags can be placed within the room (e.g., at the corner of room, room boundary, and/or listening position) and the distance from each standalone marker to the master entered into the processor.

When UWB communication (such as DecaWave DW1000) is established among the speakers in the room 70, at block 408 in FIG. 4 the master device and/or CE device 12 and/or other device implements a location module according to the location determination references above, determining the number of speakers in the room 70 and their locations, and if desired presenting the speakers at the determined locations (along with the sound bar 310 and subwoofer 213) as shown at 314A-D in FIG. 3. The lines 316 shown in FIG. 3 illustrate communication among the speakers 310, 312, 314 and may or may not be presented in the UI of FIG. 3.

In an example implementation, a component in the system such as the master device or CE device 12 originates two-way UWB ranging with the UWB elements of the fixed locations described above. Using the results of the ranging, range and direction to each speaker from the originating device are determined using techniques described in the above-referenced location determination documents. If desired, multiple rounds of two-way ranging can be performed with the results averaged for greater accuracy.

In the case in which the sound bar/TV 310 is too small or for other reasons does not have two UWB tags 306, 308, but has only a single UWB tag. The CE device 12 may conduct two-way ranging from itself to the sound bar/TV 310 and from itself to the UWB tag of one of the speakers 314. The angles of arrival to the CE device 12 from each of the sound bar/TV 310 signal and speaker 314 signal are measured to determine the directions in which the speaker 314 and sound bar/TV 310 are relative to the CE device 12, which is assumed to be at a central location in the room or whose location is input by the user-touching the appropriate location on the UI of FIG. 3.

The two way ranging described above may be effected by causing the CE device 12 (or other device acting as a master for purposes of speaker location determination) to receive a poll message from an anchor point. The CE device 12 sends a response message to the poll message. These messages can convey the identifications associated with each UWB tag or transmitter. In this way, the number of speakers can be known.

The polling anchor point may wait a predetermined period known to the CE device 12 and then send a final poll message to the CE device 12, which can then, knowing the predetermined period from receipt of its response message that the anchor point waited and the speed of the UWB signals, and the time the final message was received, determine the range to the anchor point. When a UWB tag is implemented as two integrated circuits with respective antennas distanced from each other by a known distance, the ICs/antennae can be synchronised with each other to triangulate receipt of an incoming signal and thus determine the angle of arrival of the signals. In this way, both the range and bearing from the CE device 12 to the anchor point can be determined. The above message exchange can be further optimized to require only two messages to be exchanged between active devices.

While FIGS. 3 and 4 are directed to finding the locations of the speakers in two dimensions, their heights (elevations) in the room 70 may also be determined for a three dimensional location output. The height of each speaker can be manually input by the user or determined using an altimeter associated with each speakers or determined by implementing a UWB tag in, e.g., the CE device 12 as three integrated circuits with respective antennas distanced from each other by a known distances, enabling triangulation in three dimensions.

The primary listener location is then determined according to discussion below related to FIG. 7. The number of speakers and their locations in the room are now known. Any speakers detected as above that lie outside the room may be ignored. A GUI may be presented on the CE device of the user showing the room and speakers therein and prompting the user to confirm the correctness of the determined locations and room dimensions.

Figure 5:
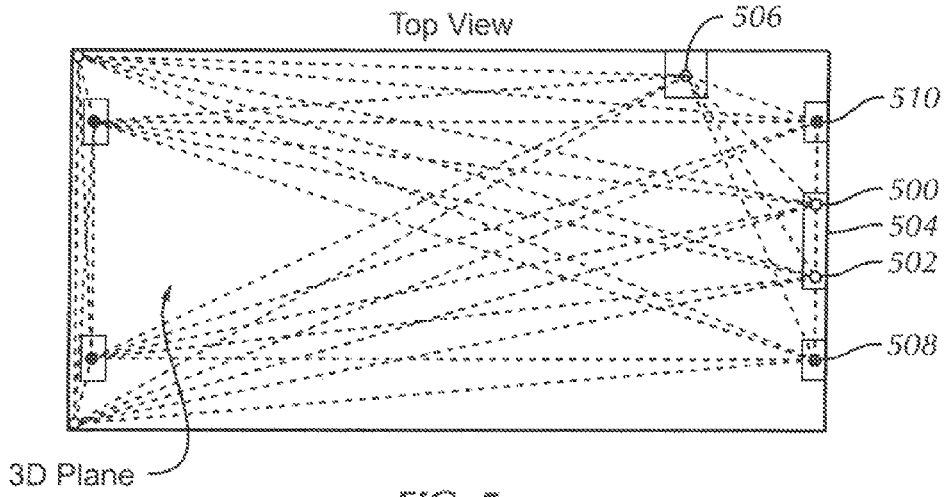
FIGS. 5-7 are additional screen shots of example UIs related to speaker location determination.
Figure 6:
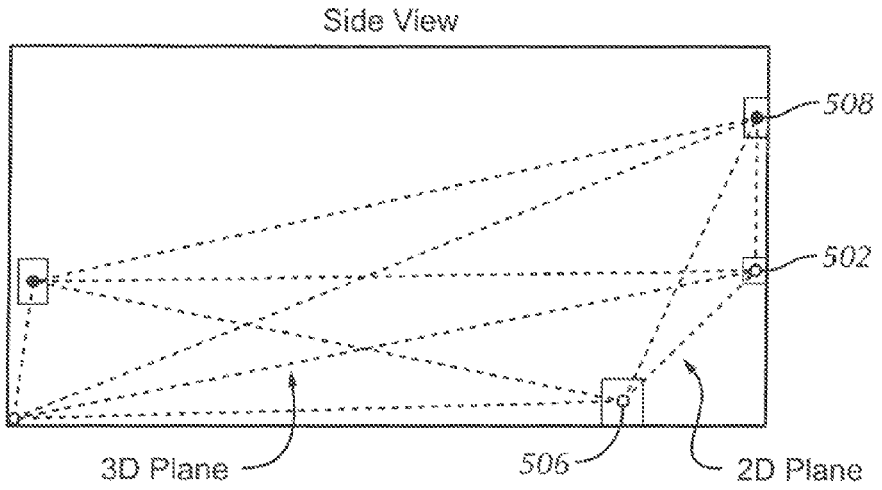

FIGS. 5 and 6 illustrate aspects of an implementation of the 3D location determination. These figures may be presented as UIs on the CE device 12. Four known locations are provided to determine the location of each speaker in three dimensions. In the example shown in FIG. 5, the user has input the locations 500, 502 associated with a sound bar/TV 504 and the location of the subwoofer 506. The user has also identified (e.g., by touching the display 14 of the CE device 12 at the appropriate locations) two corners 508, 510 of the room 70, preferably corners in which locators such as UWB tags have been positioned. Determination of the number of speakers and locations in 3D using triangulation discussed above and the techniques described in the above-referenced location determination references is then made. Note that while FIGS. 5 and 6 respectively show a top view and a side view of the room 70 on the display 14 in two separate images, a single 3D image composite may be presented.

Figure 7:
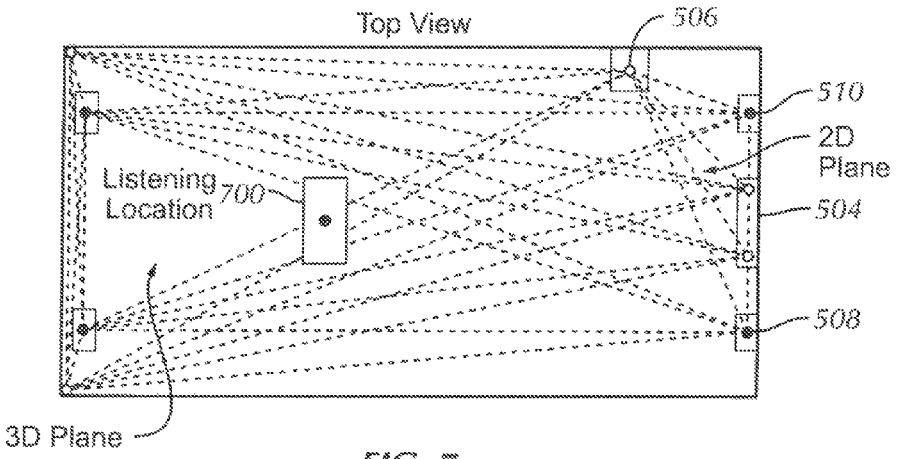

FIG. 7 illustrates yet another UI that can be presented on the CE device 12 in which the user has entered, at 700, the expected location of a listener in the room 700. Or, the location 700 can be automatically determined, e.g., by determining, based on a respective UWB tag associated with it, the location of Ce device 12, inferring that the listener is co-located with the device. Yet again, for purposes of up-mixing according to the rendering references incorporated above, a default location, may be assumed, e.g., the geometric center of the room 70, or alternatively about ⅔ of the distance from the front of the room (where the sound bar or TV is usually located) to the rear of the room.

Once the number and locations of the speakers are known, the up mixing at block 206 may be executed using the principles discussed in the above-referenced rendering documents. Specifically, the stereo audio (either as received stereo or resulting from down-mixing of non-stereo input audio at block 204) is up-mixed to, as an example, N.M audio, wherein M=number of subwoofers (typically one) and N=number of speakers other than the sub-woofer. As detailed in the rendering documents, the up-mixing uses the speaker locations in the room 70 to determine which of the "N" channels to assign to each of the respective N speakers, with the subwoofer channel being always assigned to the subwoofer. The listener location 700 shown in FIG. 7 can be used to further refine channel delay, EQ, and volume based on the speaker characteristics (parameters) to optimize the sound for the listener location.

One or more measurement microphones, such as may be established by the microphones 80 in FIG. 1, may be used if available to further calibrate the channel characteristics. This may be made based on information received from the individual speakers/CPU 50 indicating microphones are on the speakers, for example.

If measurement microphones are available, the user can be guided through a measurement routine. In one example, the user is guided to cause each individual speaker in the system to emit a test sound ("chirp") that the microphones 80 and/or microphone 18 of the CE device 12 detect and provide representative signals thereof to the processor or processors executing the logic, which, based on the test chirps, can adjust speaker parameters such as EQ, delays, and volume.

The example above uses a centralized master device to up-mix and render each of the audio channels, sending those channels to the respective speakers. When wireless connections are used and bandwidth is limited, the distributed architecture shown in FIG. 8 may be used, in which the same stereo audio from a master is sent to each speaker, and each speaker renders, from the stereo audio, its own respective channel.

Thus, as shown, a master 800, which may include a speaker such as a sound bar or TV in the system, may receive analog audio 802 and/or digital audio 804 and/or audio 806 from a computer network such as the Internet. The master 800 may include one or more wireless transceivers, indicated by the antenna symbol 808, for wirelessly communicating with other speakers 810 in the system, which include respective wireless transceivers 812. One or more control devices 814 (which may be implemented by, e.g., the CE device 12 described above) may also wirelessly communicate with the master 800 and speakers 810.

Figure 9:
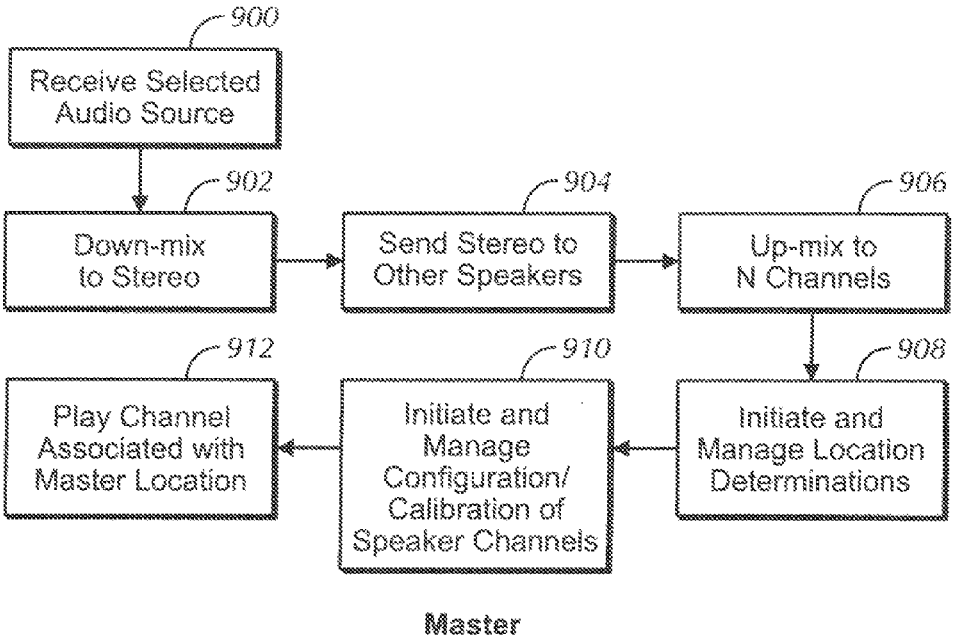
FIGS. 9-11 are flow charts of example logic pertaining to the distributed system of FIG. 8.

FIG. 9 illustrates logic that may be executed by the master device 800. Commencing at block 900, the master receives a selected audio input source. If the audio is not stereo, the master down-mixes it to stereo at block 902. The down-mixed stereo (or input stereo if the audio was received as stereo) is sent to the speakers 810 at block 904.

Moving to block 906, the master, when it also performs a speaker function, up-mixes the stereo into "N" channels, wherein "N" is the number of speakers in the system. At block 908, the master initiates and manages location determination of the speakers in the system according to principles above. The master may also initiate and manage configuration and calibration of the speakers/channels at block 910 according to principles above. Then at block 912 the master, when it functions as a speaker, plays the channel associated with the location of the master at block 912, applying calibrated EQs, delays, etc. to its audio.

Figure 10:
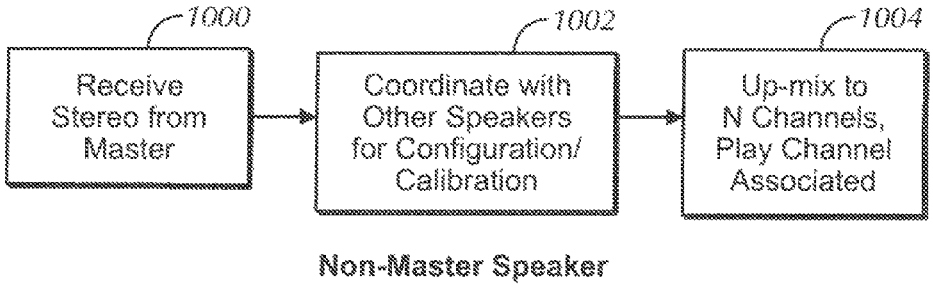

FIG. 10 shows that a non-master speaker 810 receives the stereo from the master at block 1000. According to location determination principles above, the speaker coordinates with the other speakers in the system at block 1002 to establish speaker location determination for speaker/channel configuration and calibration. At block 1004 the speaker up-mixes the stereo to "N" channels and based on its location, selects the channel output by the up-mixing algorithm for that location, applying calibrated EQs, delays, etc. to its audio.

Figure 8:
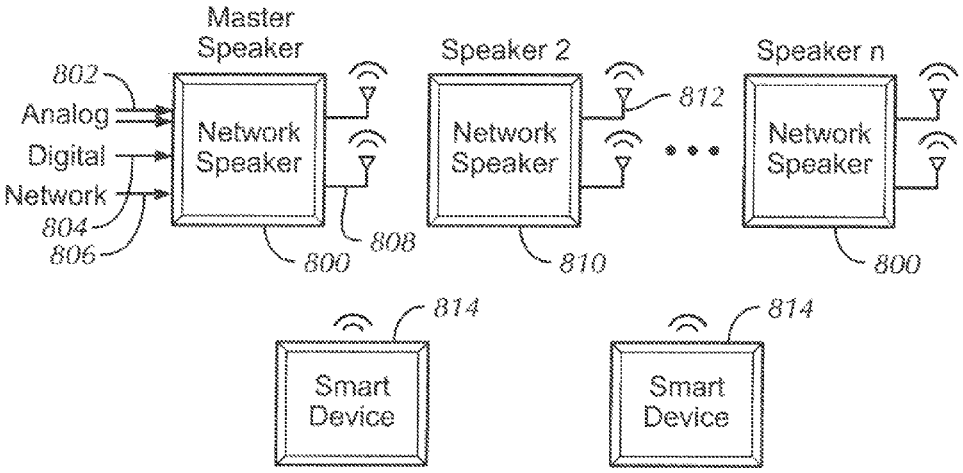
FIG. 8 is a block diagram of an example distributed system, in which each speaker renders its own audio channel.
Figure 11:
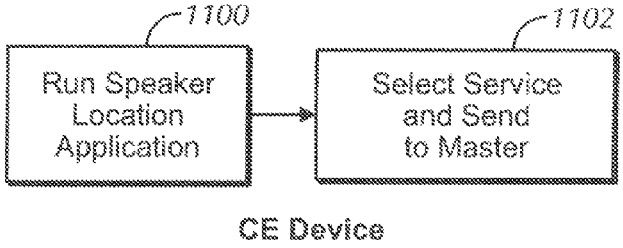

FIG. 11 illustrates example logic that one or more of the CE devices 814 in FIG. 8 may implement. A speaker location application may be executed from the device 814 at block 1100 according to speaker location determination principles discussed above. Then, at block 1102 the user operating the device 814 may select an audio source (which may be the device 814 itself) and sends a signal to the master indicating the selected source, which the master accesses at block 900 of FIG. 9.

It may now be understood that each one of the master 800 and speakers 810 accordingly readers audio based on the same stereo audio input which produces the same "N" channels and channel assignments based on the speaker locations in the system. Each speaker then selects the channel determined by the tendering algorithm to be assigned to the particular location of that speaker and plays that channel. Of course, it is only necessary that any particular speaker render only the channel it is to play, although in some implementations all channels are rendered by each speaker and then only the channel pertaining to that speaker selected for play by that speaker.

Note that the speaker in the system selected as the master may vary depending on the number and location of the speakers in the system. Thus, as speakers are moved in the room 70 by a person, assignation of which speaker is to be master can change.

Each device in the system of FIG. 8 may include one or more of the appropriate components discussed above in relation to the components of FIG. 1, including, e.g., processors, computer memories, UWB tags, etc.

Each speaker may also include one or more lamps such as light emitting diodes (LED). One or more of the processors herein may cause the lamp to illuminate (or blink) to indicate that the speaker is in a real time location mode, automatically reporting its location to the master as described previously. A different illumination pattern or different lamp may be activated to indicate a troubleshooting code, to mirror a troubleshooting code on the CE device 12, for example.

The lamp may be one or more LEDs, for instance, that can be activated to emit different color light for respective different situations. For example, the lamp(s) can be activated to represent other functions relating to home automation. Or, the lamp(s) may be activated to indicate that the respective speaker is new to the system or requires a new configuration as it might when it is moved outside of a room in which it was initially configured, requiring a new auto configuration process as discussed above for the new room.

While the particular DISTRIBUTED WIRELESS SPEAKER SYSTEM is herein shown and described in detail, it is to be understood that the subject matter which is encompassed by the present invention is limited only by the claims.

What is claimed is:

1. A device comprising:

at least one computer medium that is not a transitory signal and that comprises instructions executable by at least one processor to:

receive input audio;

responsive to identifying that the input audio is not stereo, down-mix the input audio to stereo;

responsive to identifying that the input audio is stereo, not down-mix the input audio;

receive a number "N" representing a number of speakers in a network of speakers;

send to each respective speaker the stereo such that each respective $N^{th}$ speaker can render the stereo into at least an $N^{th}$ channel, such that a first speaker renders from the stereo at least a first channel for play thereof by the first speaker, a second speaker renders from the stereo at least a second channel for play thereof by the second speaker, and an $N^{th}$ speaker renders from the stereo at least an $N^{th}$ channel for play by the $N^{th}$ speaker.

2. The device of claim 1, wherein the device is a consumer electronics (CE) device.

3. The device of claim 1, wherein the device is a master device.

4. The device of claim 1, wherein the device is a network server communicating with a consumer electronics (CE) device associated with the network of speakers.

5. The device of claim 1, wherein the device is configured to up-mix the stereo into "N" channels for play by the device of one of the "N" channels.

6. The device of claim 1, wherein the instructions are executable to:

receive the number "N" representing the number of speakers and information representing a respective location of each speaker from a location determination module that automatically determines at least one location of at least one speaker using ultra wide band (UWB) signal transmission.

7. The device of claim 5, wherein up-mix of the stereo is based on both the number "N" of speakers and the locations of the speakers.

8. The device of claim 6, wherein the instructions are executable to:

receive at least three fixed points in a space associated with the speakers in the network; and at least in part based on the three fixed points and on UWB signaling in the network of speakers, output at least one speaker location in the space.

9. The device of claim 6, wherein the instructions are executable to:

receive at least four fixed points in a space associated with the speakers in the network; and at least in part based on the four fixed points and on UWB signaling in the network of speakers, output at least one speaker location in the space.

10. The device of claim 6, wherein the instructions are executable to:

receive at least an expected listening location in the space; and at least in part based on the expected listening location, up-mix the stereo to render the "N" channels.

11. A method comprising:

automatically determining, based at least in part on wireless signaling, respective locations of at least some respective speakers in a network of speakers;

automatically determining a number "N" of speakers in the network;

sending each speaker in the network audio formatted in stereo; and based at least in part on the number "N" of speakers in the network and the respective locations of the speakers, up-mixing the stereo at each respective $N^{th}$ speaker into a respective $N^{th}$ channel, such that a first speaker plays only a first channel selected from the "N" channels, a second speaker plays only a second channel selected from the "N" channels, and an $N^{th}$ speaker plays only an $N^{th}$ channel selected from the "N" channels.

12. The method of claim 11, comprising receiving the number "N" representing the number of speakers and information representing the respective locations of the speakers from a location determination module that automatically determines at least one location of at least one speaker using ultra wide band (UWB) signal transmission.

13. The method of claim 12, comprising:

receiving at least three fixed points in a space associated with the speakers in the network; and at least in part based on the three fixed points and on UWB signaling in the network of speakers, outputting at least one speaker location in the space.

14. The method of claim 13, comprising:

receiving at least an expected listening location in the space; and at least in part based on the expected listening location, up-mixing the stereo to render the "N" channels.

15. A system comprising:

N speakers;

at least one master device configured to receive audio and to communicate with the speakers;

the master device configured with instructions executable to:

down-mix input audio to stereo;

transmit to each speaker the stereo;

each speaker being configured with instructions executable to:

up-mix the stereo into "N" channels; and play a respective channel from among the "N" channels.

16. The system of claim 15, wherein the instructions of each speaker are executable to:

receive a number "N" representing the number of speakers and information representing a respective location of each speaker from a location determination module that automatically determines at least one location of at least one speaker using ultra wide band (UWB) signal transmission.

17. The system of claim 16, wherein the up-mix is based on both the number "N" of speakers and the locations of the speakers.

18. The system of claim 16, wherein the instructions of the master device are executable to:

receive at least three fixed points in a space associated with the speakers in the network; and at least in part based on the three fixed points and on UWB signaling in the network of speakers, output at least one speaker location in the space.

19. The system of claim 16, wherein the instructions of the master device are executable to:

receive at least an expected listening location in the space; and at least in part based on the expected listening location, up-mix the stereo to render the "N" channels.

20. The system of claim 16, wherein the master device is configured to wirelessly send the stereo to the speakers.

* * * * *